US005219237A

United States Patent [19]

Zonneveld

[11] Patent Number: 5,219,237

[45] Date of Patent: Jun. 15, 1993

[54] DEPILATION APPARATUS

[75] Inventor: Maarten H. Zonneveld, Eindhovern, Netherlands

[73] Assignee: U.S. Philips Corp., New York, N.Y.

[21] Appl. No.: 821,214

[22] Filed: Jan. 16, 1992

[30] Foreign Application Priority Data

Feb. 15, 1991 [NL] Netherlands ..... 9100266

[51] Int. Cl.[5] ..... A45D 40/00; A45D 40/26; A45D 34/04

[52] U.S. Cl. ..... 401/1; 401/2

[58] Field of Search ..... 401/1, 2, 208

[56] References Cited

U.S. PATENT DOCUMENTS

| | | | |
|---|---|---|---|
| 2,174,486 | 8/1939 | Van Fleet | 401/2 |
| 3,298,572 | 1/1967 | Newton | 401/2 X |
| 3,969,025 | 7/1976 | Brodie | 401/2 |
| 4,773,784 | 9/1988 | Mann | 401/1 |

*Primary Examiner*—Steven A. Bratlie
*Attorney, Agent, or Firm*—Ernestine C. Bartlett

[57] ABSTRACT

The invention relates to a depilation apparatus of the type with which liquid wax is applied to the skin, which wax is removed together with the hairs after solidification, the apparatus comprising a housing (1) with a reservoir (2) for holding a wax block (3), which reservoir is in connection with an outlet opening (4) in a wall of the housing, the apparatus being provided with a rotatable distributor roller (5) near the outlet opening for applying the liquid wax to the skin. To obtain shorter heating-up times as well as a good sealing for the wax block, the apparatus is provided with a heater element (7) located between the end of the reservoir (2) and the distributor roller (5), while a heat-conducting sealing (10) for the wax block is present near the end of the reservoir (2) facing the distributor roller.

6 Claims, 2 Drawing Sheets

DEPILATION APPARATUS

FIELD OF THE INVENTION

The invention relates to a depilation apparatus of the type with which liquid wax is applied to the skin, which wax is removed together with the hairs after solidification, the apparatus comprising a housing with a reservoir for holding a wax block, which reservoir is in connection with an outlet opening in a wall of the housing, the apparatus being provided with a rotatable distributor roller near the outlet opening for applying the liquid wax to the skin.

BACKGROUND OF THE INVENTION

Such a depilation apparatus is known from U.S. Pat. No. 4,773,784.

In this known depilation apparatus, the entire wax stock is first heated up to the operating temperature. This is done in that the apparatus is placed in a holder in which a heater element is present. After the wax has been applied, the apparatus is returned to the holder so that the wax can be heated up and melted again. The heating-up times are comparatively long as a result of the bad the conduction of the wax.

The dipilation apparatus according to the invention is based on a principle which is also used in glue guns. Here only an end of the material to be melted lies against a heater element. Short heating-up times are possible in this case. A problem in this method is how to obtain a good sealing between the reservoir wall and the solid material. It should also be ensured that the material does not start melting above this seal, seen from the melting side of the material, for if it does, the material will stick to the reservoir wall after cooling down. The solid material will then no longer lie securely against the heater element during a next period of use.

SUMMARY OF THE INVENTION

The invention has for its object to provide a depilation apparatus as described in the opening paragraph in which the heating-up times are short and in which a good sealing between the reservoir wall and the wax block is obtained, while at the same time the wax block does not start melting above this seal.

According to the invention, the depilation apparatus is for this purpose characterized in that the apparatus is provided with a heater element situated between the end of the reservoir and the distributor roller, and in that a heat-conducting sealing for the wax block is present near the end of the reservoir facing the distributor roller.

An advantage of the depilation apparatus according to the invention is that melting of the wax block takes place only at the end thereof facing the heater element, so that short heating-up times are obtained and the sealing can remove heat to such an extent that the wax block does not melt above the sealing, seen from the melting side. Sticking of the wax block to the reservoir wall does not take place as a result.

Preferably, the sealing has a heat-conducting connection to a heat removal element. This element sees to the transfer of heat to the surroundings.

A preferred embodiment of the depilation apparatus is characterized in that the sealing is formed by a resilient tape which is provided at one side with resilient tags for making heat-conducting contact with the wax block. Thanks to the resilient tags, the tape can be bent round while the tags make effective contact with the wax block.

According to a further embodiment, the heat removal element is formed by a ring which is provided with a cooling plate which lies at the exterior of the housing. A good heat transfer to the surroundings can take place as a result.

An alternative embodiment of the depilation apparatus is characterized in that the sealing is formed by a package of flexible plates of which the heat conduction coefficient $\lambda$ lies between 1 and 5 W/(mK), which flexible plates are mutually separated and supported by cooling plates which constitute the heat removal element. Not only the sealing is improved by this, but also the heat removal from the ends of the flexible plates which make contact with the wax block.

A further improvement of the heat removal is obtained when the cooling plates extend to beyond the flexible plates and are thermally interconnected. This promotes an effective removal of the heat from the end of the wax block where the temperature is highest.

BRIEF DESCRIPTION OF THE DRAWINGS

The invention will now be explained in more detail with reference to an embodiment shown in a drawing, in which.

DETAILED DESCRIPTION OF THE PREFERRED EMBODIMENTS

Figure 1:
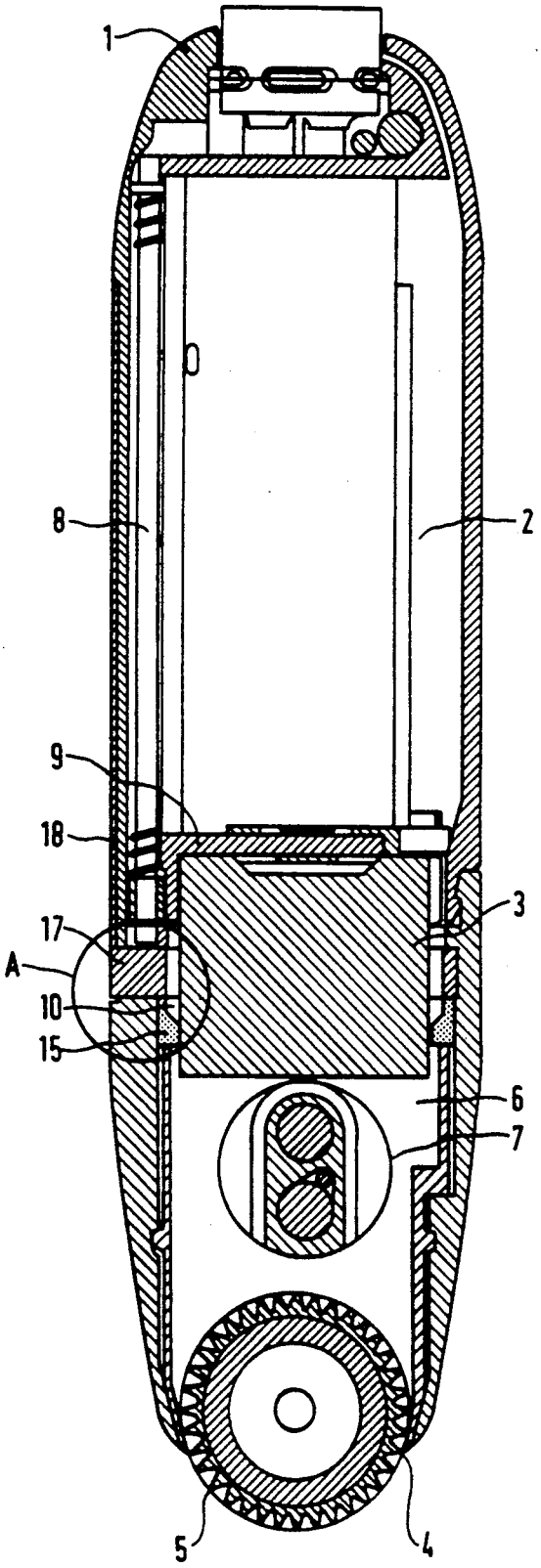
FIG. 1 is a cross-section of a depilation apparatus according to the invention.

The depilation apparatus is built up from a housing 1 comprising a reservoir 2 for holding a wax block 3, an outlet opening 4 for the liquid wax, and a rotatable distributor roller 5 situated in the outlet opening. Furthermore, a heater element 7 against which the wax block to be melted rests is present in the housing between the end 6 of the reservoir 2 and the distributor roller 5. The wax block is held against the heater element by resilient pressure means 8, 9.

Figure 2A:
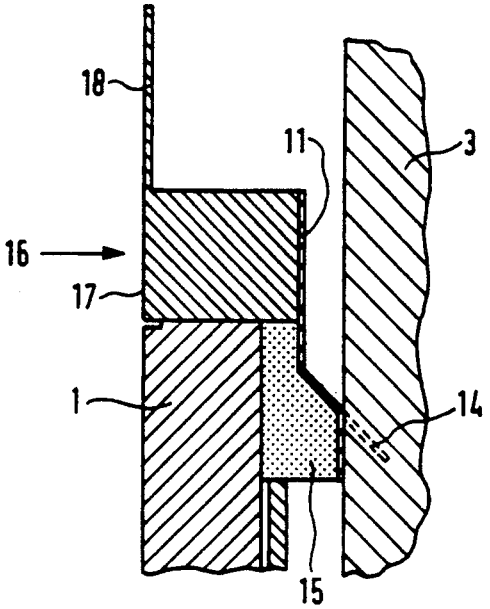
FIG. 2A shows the ehat-conducting sealing between the reservoir wall and the wax block of FIG. 1 as well as the heat removal element.
Figure 3:
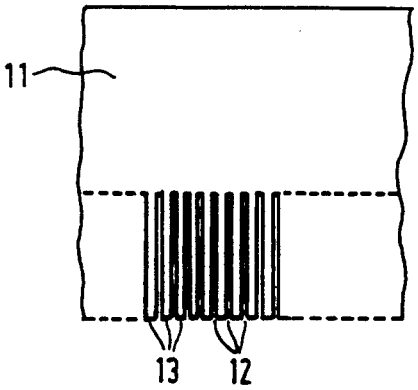
FIG. 3 is a partial elevation of the heat-conducting sealing, and FIG. 4A diagrammatically depicts an alternative heat-conducting sealing for the wax block.

According to the invention, a heat-conditioning sealing 10, which is pictured in detailed FIG. 2A, is present near the end 6 of the reservoir 2. The sealing is formed by a resilient tape 11 in which a large number of incisions 12 are provided at one side, so that resilient tags 13 are formed (see FIG. 3). As a result, the resilient tape 11 can be bent round so that all resilient tags 13 have a good heat contact with the wax block 3. The wax block in this example has an oval cross-section. When the wax block is not present, the resilient tags 13 assume a position as indicated with a broken line 14. The tape may be manufactured, for example, from a beryllium-copper alloy. This alloy has a good heat condition. At the other side of the wax block 3, the resilient tags 13 lie against an insulation ring 15 made of foam rubber which at the same time serves as a pressure member. The resilient tape 11 is connected with good heat conduction to a heat removal element 16. This heat removal element is formed by a ring 17 to which a cooling plate 18 is fastened. The cooling plate is at the outside of the housing 1 so that a good heat transfer to the surroundings can take place.

Figure 4A:
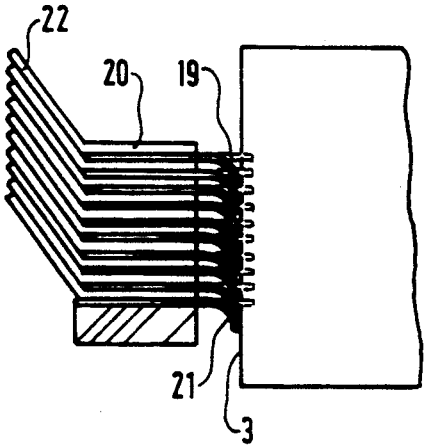

FIG. 4A diagrammatically shows an alternative heat-conducting sealing. This sealing consists of a package of flexible plates 19 between which cooling plates 20 are accommodated. The thin flexible plates have a comparatively high thermal conductivity. This may be achieved in that, for example, the basic material rubber is mixed with a filler whereby a heat conduction coefficient $\lambda$ of 1 to 5 W/(mK) can be achieved. The ends 21 of the flexible plates 19, which lie against the wax block 3, deflect along with the direction of movement of the wax block and thus have a comparatively large contact area with the wax block. A good sealing action as well as a good heat removal from the wax block is obtained by this. The cooling plates 20 accommodated between the flexible plates are effective for a further removal of the heat. It is of special importance for the heat from the lowermost flexible plates 19, where the temperature of the wax block is highest, to be effectively removed. For this purpose, the ends 22 of the cooling plates which extend to beyond the flexible plates 19 are bent to one side, as a result of which they automatically lie against one another and are thermally interconnected.

I claim:

1. A depilation apparatus of the type with which liquid wax is applied to the skin, which wax is removed together with the hairs after solidification, the apparatus comprising a housing (1) with a reservoir (2) for holding a wax block (3), which reservoir is in connection with an outlet opening (4) in a wall of the housing, the apparatus being provided with a rotatable distributor roller (5) near the outlet opening for applying the liquid wax to the skin, wherein the apparatus is provided with a heater element (7) situated between the end of the reservoir (2) and the distributor roller (5), and in that a heat-conducting sealing (10) for the wax block is present near the end of the reservoir (2) facing the distributor roller.

2. A depilation apparatus as claimed in claim 1, wherein the sealing has a heat-conducting connection to a heat removal element.

3. A depilation apparatus as claimed in claim 2, wherein the sealing is formed by a resilient tape (11) which is provided at one side with resilient tags (13) for making heat-conducting contact with the wax block (3).

4. A depilation apparatus as claimed in claim 3, wherein the heat removal element (16) is formed by a ring (17) which is provided with a cooling plate which lies at the exterior of the housing (1).

5. A depilation apparatus as claimed in claim 2, wherein the sealing (10) is formed by a package of flexible plates (19) of which the heat conduction coefficient $\lambda$ lies between 1 and 5 W/(mK), which flexible plates (19) are mutually separated and supported by cooling plates which constitute the heat removal element.

6. A depilation apparatus as claimed in claim 5, wherein the cooling plates (20) extend to beyond the flexible plates (19) and are thermally interconnected.

* * * * *